US005213633A

United States Patent [19]

Hada et al.

[11] Patent Number: 5,213,633

[45] Date of Patent: May 25, 1993

[54] ELECTRIC RESISTANCE WELDED STEEL TUBE FOR MACHINE STRUCTURAL USE EXHIBITING OUTSTANDING MACHINABILITY

[75] Inventors: Kenji Hada; Yasuo Kimiya; Daigo Sumimoto, all of Chibaken, Japan

[73] Assignee: Nippon Steel Corporation, Tokyo, Japan

[21] Appl. No.: 794,885

[22] Filed: Nov. 20, 1991

[30] Foreign Application Priority Data

Nov. 21, 1990 [JP] Japan ..... 2-316283

[51] Int. Cl.[5] ..... C22C 38/04; C22C 36/60

[52] U.S. Cl. ..... 148/334; 148/333; 148/320; 148/909; 420/84; 138/177

[58] Field of Search ..... 148/334, 909, 320, 333; 420/84; 138/177, DIG. 6

[56] References Cited

FOREIGN PATENT DOCUMENTS 3009491 9/1980 Fed. Rep. of Germany ..... 420/84

*Primary Examiner*—Deborah Yee

*Attorney, Agent, or Firm*—Wenderoth, Lind & Ponack

[57] ABSTRACT

An electric resistance welded steel pipe for machine structural use exhibiting excellent machinability comprises, in weight percent, 0.02–0.60% C, not more than 0.4% Si, 0.20–2.0% Mn, not more than 0.030% P, not more than 0.040% S, 0.001—0.030% T.Al, 0.0020–0.0100% N, not more than 0.0060% O, and one or both of not more than 0.040% Bi, not more than 0.040% Pb and not, Te and provided that the total amount of Bi and pb is not more than 0.050%, the remainder being Fe and unavoidable impurities. It may further comprise one or both of 0.10–1.50% Cr and 0.10–0.60% Mo and/or not more than 0.020% Ca, provided that Ca%/(1.25×0%+0.625×S%)≧0.05.

4 Claims, 2 Drawing Sheets

ELECTRIC RESISTANCE WELDED STEEL TUBE FOR MACHINE STRUCTURAL USE EXHIBITING OUTSTANDING MACHINABILITY

BACKGROUND OF THE INVENTION

1. Field of the Invention

This invention relates to electric resistance welded steel tube for machine structural use, more particularly to such tube exhibiting excellent machinability.

2. Description of the Prior Art

Advances in machining technology and increased production of automobiles and other machines have created a rising need for steel materials with outstanding machinability. Tube for machine structural use has been no exception. Automation and other measures implemented to enhance the efficiency of machining processes has led to strong demand for quality structural tube materials exhibiting good chip breakability and machined surface roughness.

For improving the machinability of general steels for machine structural use there have been developed and practically applied a number of resulfurized free-cutting steels, leaded free-cutting steels and calcium-containing free-cutting steels as well as composites of the foregoing. Examples of such steels are disclosed, for example, in Japanese Patent Public Disclosures Sho 55-85658, Sho 57-140853 and Sho 62-33747.

As disclosed in Japanese Patent Publication Sho 61-16337, in some such steels the degradation of mechanical properties caused by the inclusions formed by the addition of such free-cutting elements is suppressed by limiting the amount of Sol.Al and specifying the S, Ca and O contents.

However, these conventional free-cutting steels cannot be fabricated into steel tube for machine structural use by electric resistance welding. This is because the inclusions formed by the free-cutting elements in these steels have the general effect of degrading mechanical properties and the specific effect of degrading electric resistance weldability, and the resulting weld cracking and poor performance in ultrasonic testing (UST) of the electric resistance welded steel tube causes a marked decrease in product yield.

These problems cannot be completely overcome even by the teaching of the aforementioned Japanese Patent Publication Sho 61-16337. Moreover it is ordinarily difficult to reduce the O content of Si killed steel to 0.0040% or less.

While an attempt might be made to produce electric resistance welded steel tube by limiting the addition of the free-cutting elements within the range in which there is no large reduction of yield, such an expedient will not enable production of electric resistance welded steel tube with adequate machinability since addition of the free-cutting elements within such a range is not sufficient for preventing the degradation of chip breakability that generally occurs when the tube is subjected to cold drawing or other types of cold processing.

The object of the present invention is to overcome the foregoing problems and provide electric resistance welded steel tube for machine structural use which is able to respond to the need for improved machinability.

SUMMARY OF THE INVENTION

In its first aspect, the present invention achieves its object by providing electric resistance welded steel tube for machine structural use exhibiting excellent machinability which comprises, in weight percent, 0.02–0.60% C, not more than 0.4% Si, 0.20–2.0% Mn, not more than 0.030% P, not more than 0.040% S, 0 001–0.030% T.Al, 0.0020–0.0100% N, not more than 0.0060% O, and one or both of not more than 0.040% Bi and not more than 0.040% Pb, provided that the total amount of Bi and Pb is not more than 0.050%, the remainder being Fe and unavoidable impurities.

In its second aspect, the present invention achieves its object by providing electric resistance welded steel tube for machine structural use exhibiting excellent machinability which comprises, in weight percent, 0.02–0.60% C, not more than 0.4% Si, 0.20–2.0% Mn, not more than 0.030% P, not more than 0.040% S, 0.001–0.030% T.Al, 0.0020–0.0100% N, not more than 0.0060% O, one or both of not more than 0.040% Bi and not more than 0.040% Pb, provided that the total amount of Bi and Pb is not more than 0.050%, and not more than 0.020% Ca, provided that $Ca\%/(1.25\times O\%+0.625\times S\%)\geqq 0.05$, the remainder being Fe and unavoidable impurities.

In either aspect of the invention, the steel may additionally contain either or both of 0.10–1.50% Cr and 0.10–0.60% Mo.

DETAILED DESCRIPTION OF THE PREFERRED EMBODIMENTS

Figure 1:
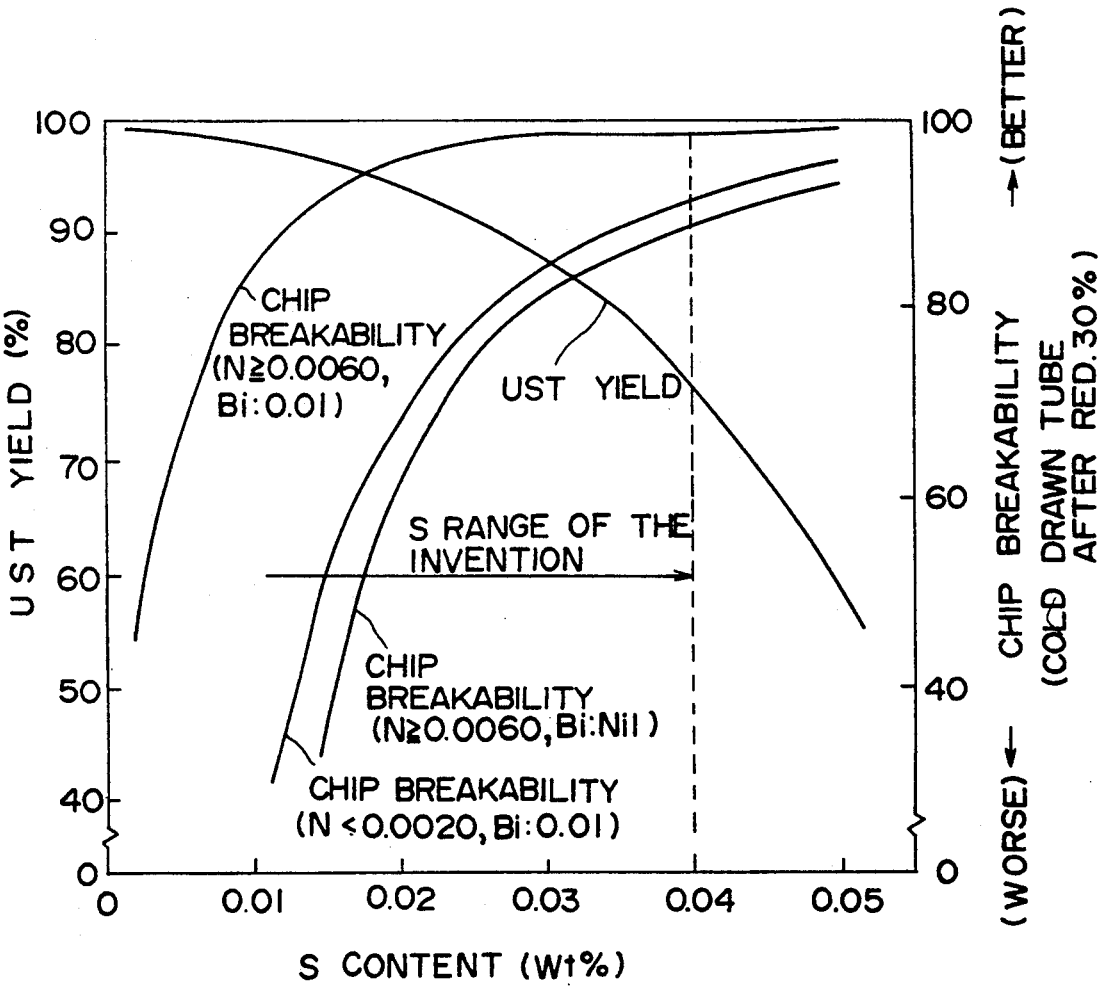
FIG. 1 is a graph illustrating the effect of the invention.

For enabling production of high quality electric resistance welded steel tube with excellent chip breakability, the invention limits the S, Ca and O contents of the steel and further, within the N and S content ranges in which no degradation of tube mechanical properties arises, maximizes the synergistic effect between these free-cutting elements and one or both of Bi and Pb.

A more detailed explanation of the invention will now be given, along with the reasons for the aforesaid composition ranges.

The invention aims at producing steel tube for machine structural use which exhibits good chip breakability, and specifically at producing such tube by electric resistance welding. It therefore limits the S, Ca and O contents of the steel so as to suppress the marked reduction in yield that would otherwise occur owing to weld cracking and poor UST performance that is caused by the presence of inclusions of free-cutting components. It concurrently improves the machinability of the steel by realizing a synergistic effect between S and N on the one hand and at least one of Bi and Pb on the other.

As C is required for ensuring mechanical strength, its lower limit is set at 0.02%. On the other hand, since a content in excess of 0.60% not only degrades steel toughness and machinability but also markedly promotes hardening and degrades workability owing to the effect of the heat produced during the electric resistance welding for tube producing, the upper limit of C is defined as 0.60%.

While Si is an element contained in steel in connection with deoxidation, excessive addition thereof reduces ductility, causes formation of Si scale which degrades the surface condition of the machined steel, and degrades the steel machinability. The Si content is therefore limited to not more than 0.4%.

Mn is an element generally indispensable for ensuring steel strength and toughness. It also helps to avoid S-induced hot brittleness. The lower limit thereof is therefore set at 0.20%. As addition of too much Mn impairs the workability and weldability of the steel, an upper limit of 2.0% is put on the Mn content.

P is an element which ordinarily improves steel machinability by increasing the brittleness of the matrix through its presence in solid solution. However, it degrades electric resistance weldability at high content levels. The upper limit of P is therefore set at 0.030%.

Although S is an element effective for improving chip breakability, a large amount of S becomes a cause for greatly reduced yield since it promotes weld cracking during electric resistance welding for tube producing, and, also since it results in poor UST performance. Its upper limit is therefore defined as 0.040%.

N is an element effective for improving machinability. It specifically promotes chip breakability by enabling the chip temperature to reach the blue brittleness zone of the steel, an effect which is manifested at a N content of 0.0020% or more. As a content of over 0.0100% degrades weldability, however, the upper limit of N is set at 0.0100%.

Al is an element generally contained in steel in connection with deoxidization. Taking products with a rimmed steel base into consideration, the lower limit of T.Al is set at 0.001%. On the other hand, since Al degrades steel machinability through the formation of alumina clusters, the upper limit is set at 0.030%. Since AlN formation reduces the blue brittleness obtained as an effect of N in this invention, it is preferable from the viewpoint of maximizing the effect of the blue brittleness for the steel to contain not more than 0.006% T.Al and not less than 0.0040% N.

Where the amounts of S and T.Al are as defined above, the presence of more than 0.0060% O causes an increase in the amount of oxides and, as a result, leads to poor UST performance. It also results in the formation of oxides in conjunction with the Ca discussed later, which reduces the amount of Ca present for controlling the shapes of the sulfide MnS in the manner described below. The O content is therefore defined as not more than 0.0060%.

Because of their low melting points, both Bi and Pb work to improve chip breakability by decreasing the ductility of the chips in the blue brittleness zone of the steel. Te effectively combines with S to prevent MnS elongation, in this way enhancing machinability. However, the addition of a large amount of Bi and/or Pb causes surface defects during hot rolling and also impairs cold workability. Therefore, for obtaining a synergistic effect in conjunction with the aforesaid S and N, at least one of Bi and Pb is added at not more than 0.040%, provided that the total amount of the two elements is not to exceed 0.050%. In this invention, the synergistic effect between S and N on the one hand and one or bitg if /bu abd Pb on the other strongly contributes to improvement of machinability and ensures that excellent chip breakability will be exhibited even by a tube which has been hardened by cold working after producing the tube.

For maximizing UST yield after tube production and also for extending the service life of the machine tool and obtaining excellent mechanical properties after cold working, it is effective to add Ca to the steel as discussed in the following.

By its effect toward controlling the shape of the sulfide MnS, Ca works to improve the steel toughness. In addition, it forms oxides which help to extend tool service life and reduce machining force. On the other hand, when present at a content of more than 0.020%, it forms large inclusions which adversely affect toughness and electric resistance weldability. The upper limit of the Ca content in this invention is therefore set at 0.020%.

Moreover, ensuring that the value of $Ca\%/(1.25\times O\%+0.625\times S\%)$ is not less than 0.05 has the effect of suppressing the MnS elongation which tends to cause poor UST performance at the time of electric resistance welding for tube production. (The denominator in the foregoing inequality represents the amount of Ca required for Ca to combine effectively with S as CaS so as to suppress elongation of MnS by causing most of the sulfides to assume an elliptical shape, and also required for causing Ca and Al to effectively combine to form the low melting point oxides $CaO.Al_2O_3$.)

This invention can also be utilized with steels whose corrosion resistance has been enhanced by addition of 0.10% or more of such alloying elements as Cr, Mo and the like and, specifically, can be applied both to carbon steel and to various types of alloy steels. Since these alloying elements tend to degrade the machinability of the alloy steel for machine structural use when added in large amounts, the upper limit of the Cr content is defined as 1.50% and that of Mo as 0.60%. If necessary, Nb, W and the like can be included for reducing grain size and increasing toughness. The invention also enables improvement of mechanical properties through the inclusion of rare-earth metals.

After a steel having the aforesaid chemical composition according to the invention has been produced in a converter, electric furnace or the like, it is either ingotted-bloomed or continuously cast. The resulting slab is hot rolled into a plate which, if required, is cold rolled and is then formed into a tube and electric resistance welded. If necessary, the tube is subjected to a prescribed heat treatment and/or is cold drawn to a prescribed outer diameter. The result is a tube for machine structural use.

EXAMPLE

Table 1 shows the chemical compositions of steels produced according to the invention. After steel making, continuous casting and hot rolling, the steels of the composition shown in this table were electric resistance welded into $\phi 50.8\times t5.0$ mm electric resistance welded steel tubes. After being so produced, all of the tubes were subjected to ultrasonic testing (UST). The UST yield values and the results of workability tests conducted are shown in Table 2. The produced tubes were then subjected to heat treatment and cold drawing, whereafter they were put to a machining test using a lathe. The results of this test are also shown in Table 2. The various results mentioned above are graphically illustrated in FIGS. 1 and 2, from which the effect of the invention can be ascertained.

The machining test was conducted using a cemented carbide tool at a rotational speed of 300–800 RPM, a feed of 0.10–0.50 mm/rev., a machining speed of 50 200 mm/min. and a cut depth of 1.5 mm. The chips were collected. The chip breakability shown in the FIG- URES is the ratio of the number of cases in which a chip length of not more than 50 mm was obtained to the total number of cases, expressed as a percentage.

Figure 2:
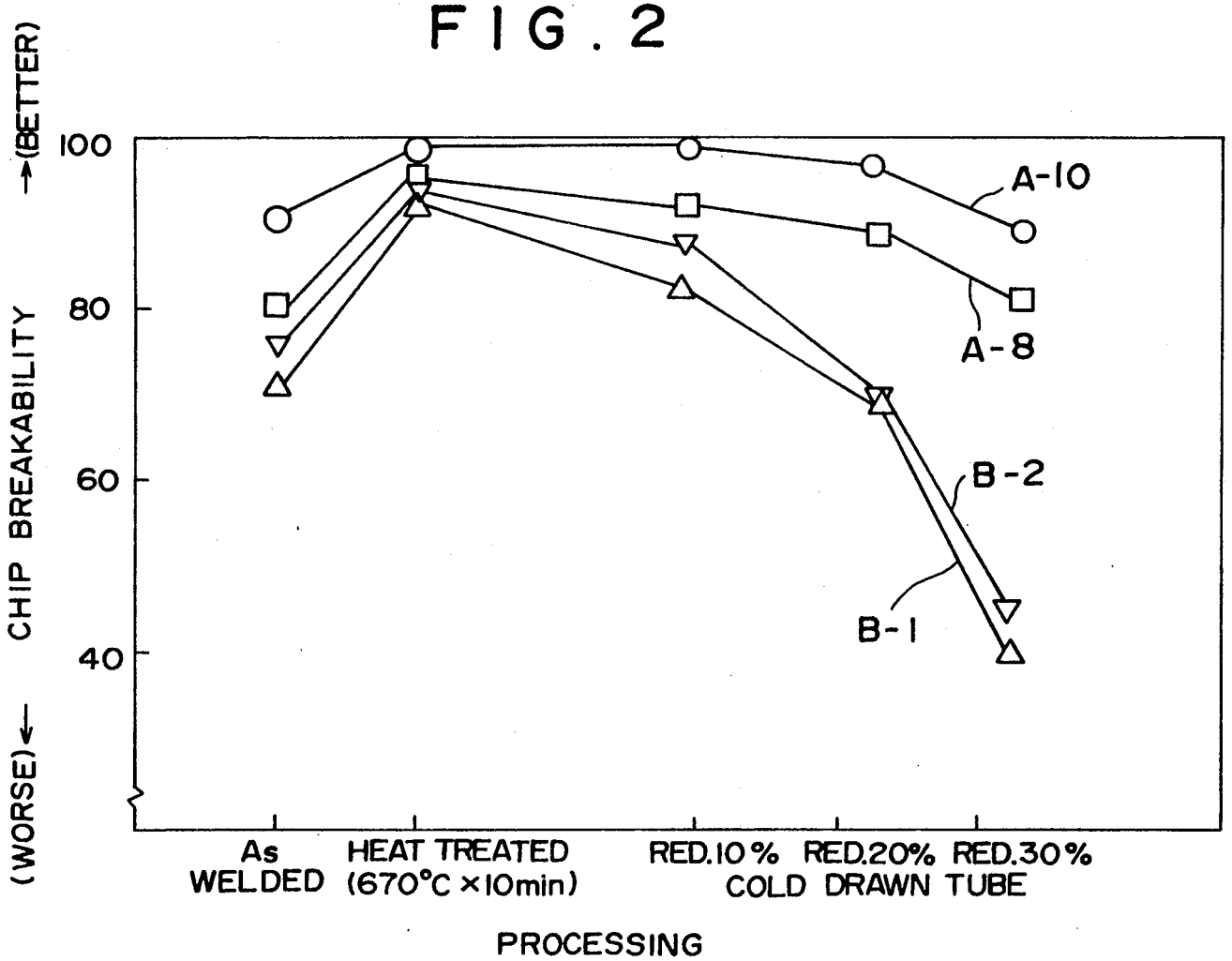
FIG. 2 is a graph showing the results of machining tests conducted using steels according to the invention and comparison steels.

As can be seen from Table 2 and FIG. 1, conventional electric resistance welded steel tubes for machine structural use having a low S content have a good yield in UST but exhibit poor chip breakability. On the other hand, conventional free-cutting steels with a high S content can be seen to have good chip breakability but to be markedly inferior as regards the UST yield. In contrast it will be noted that specifying the S, N, C and 0 contents within the ranges of the invention enables production of electric resistance welded steel tube exhibiting good chip breakability, with no sharp decline in yield. It can further be seen from FIG. 2 that the synergistic effect between S and N on the one hand and one or both of Bi and Pb and Te on the other results in good chip breakability even in tube that has been cold worked.

TABLE 2-continued

| No. | UST yield (%) | Workability tests: Flattening | Flaring | Reverse flattening | Chip breakability | Remarks |
|---|---|---|---|---|---|---|
| A-10 | 92 | Good | Good | Good | 80 | |
| A-11 | 94 | Good | Good | Good | 90 | |
| B-1 | 96 | Good | Good | Good | 40 | |
| B-2 | 98 | Good | Good | Good | 45 | |
| B-3 | 94 | Good | Good | Good | 45 | |
| B-4 | 92 | Good | Good | Good | 50 | |
| C-1 | 55 | Good | Good | Good | 95 | |
| C-2 | 48 | Good | Good | Poor | 100 | |
| C-3 | 35 | Poor | Poor | Poor | 100 | Cracking during tube drawing |
| D-1 | 98 | Good | Good | Good | 30 | |
| D-2 | 98 | Good | Good | Good | 25 | |
| D-3 | 96 | Good | Good | Good | 30 | |
| D-4 | 97 | Good | Good | Good | 30 | |

As can be seen from the foregoing examples, when the S, Ca and O contents of the raw material for producing electric resistance welded steel tube for machine structural use are specified within the ranges of the invention, there is almost no decrease in the yield at the time of UST. Moreover, the synergistic effect between S and N on the one hand and one or both of Bi and Pb on the other results in extremely good machinability. The invention thus makes it possible to produce electric resistance welded steel tube for machine structural use which exhibits excellent machinability.

What is claimed is:

TABLE 1

| No. | Chemical Composition (wt. %): C | Si | Mn | P | S | T.Al | Ca | O | N | Other | [Ca] 1.25[O] + 0.625[S] | Heat treatment conditions (°C. × min.) | Cold drawing conditions Red. (%) | Remarks |
|---|---|---|---|---|---|---|---|---|---|---|---|---|---|---|
| A-1 | 0.13 | 0.25 | 0.62 | 0.011 | 0.022 | 0.033 | — | 0.0048 | 0.0052 | Bi: 0.006 | — | 670 × 10 | 32.5 | This Invention Claim 1 |
| A-2 | 0.08 | 0.28 | 0.71 | 0.012 | 0.007 | 0.011 | — | 0.0045 | 0.0078 | Pb: 0.025 | — | 670 × 10 | 32.5 | |
| A-3 | 0.09 | 0.20 | 0.43 | 0.015 | 0.021 | 0.003 | — | 0.0035 | 0.0048 | Cr: 1.10, Mo: 0.19 Pb: 0.020 | — | 670 × 10 | 32.5 | This Invention Claim 2 |
| A-4 | 0.16 | 0.18 | 0.58 | 0.018 | 0.019 | 0.002 | 0.0023 | 0.0035 | 0.0021 | Bi: 0.005 | 0.14 | 670 × 10 | 32.5 | This Invention Claim 3 |
| A-5 | 0.12 | 0.23 | 0.58 | 0.013 | 0.006 | 0.003 | 0.0025 | 0.0045 | 0.0068 | Bi: 0.012 | 0.27 | 670 × 10 | 32.5 | |
| A-6 | 0.10 | 0.21 | 0.49 | 0.008 | 0.024 | 0.002 | 0.0018 | 0.0035 | 0.0065 | Bi: 0.010 | 0.09 | 670 × 10 | 32.5 | |
| A-7 | 0.15 | 0.23 | 0.51 | 0.009 | 0.021 | 0.014 | 0.0022 | 0.0025 | 0.0079 | Bi: 0.020 | 0.14 | 670 × 10 | 32.5 | |
| A-8 | 0.17 | 0.18 | 0.60 | 0.018 | 0.023 | 0.002 | 0.0028 | 0.0038 | 0.0073 | Pb: 0.005 | 0.15 | 670 × 10 | 32.5 | |
| A-9 | 0.25 | 0.18 | 0.52 | 0.010 | 0.025 | 0.002 | 0.0023 | 0.0042 | 0.0065 | Bi: 0.021 | 0.14 | 720 × 10 | 32.5 | |
| A-10 | 0.13 | 0.26 | 0.63 | 0.011 | 0.025 | 0.004 | 0.0015 | 0.0049 | 0.0063 | Cr: 1.0, Mo: 0.23 Bi: 0.021 | 0.07 | 670 × 10 | 32.5 | |
| A-11 | 0.13 | 0.18 | 0.48 | 0.015 | 0.022 | 0.004 | 0.0025 | 0.0049 | 0.0063 | Cr: 0.8, Mo: 0.21 Bi: 0.021, Pb: 0.012 | 0.13 | 670 × 10 | 32.5 | |
| B-1 | 0.14 | 0.28 | 0.62 | 0.015 | 0.005 | 0.003 | 0.0028 | 0.0042 | 0.0068 | — | 0.19 | 670 × 10 | 23.0 | Comparative example |
| B-2 | 0.13 | 0.23 | 0.50 | 0.014 | 0.015 | 0.004 | 0.0020 | 0.0033 | 0.0050 | — | 0.15 | 670 × 10 | 23.0 | |
| B-3 | 0.15 | 0.22 | 0.53 | 0.013 | 0.025 | 0.004 | 0.0013 | 0.0042 | 0.0023 | — | 0.09 | 670 × 10 | 23.0 | |
| B-4 | 0.32 | 0.28 | 0.63 | 0.018 | 0.018 | 0.003 | 0.0018 | 0.0043 | 0.0078 | — | 0.11 | 850 × 10 | 23.0 | |
| C-1 | 0.18 | 0.25 | 0.51 | 0.016 | 0.045 | 0.018 | — | 0.0070 | 0.0029 | — | — | 670 × 10 | 32.5 | Conventional free-cutting steel |
| C-2 | 0.22 | 0.26 | 0.51 | 0.013 | 0.043 | 0.025 | 0.0057 | 0.0030 | 0.0032 | — | 0.04 | 720 × 10 | 32.5 | |
| C-3 | 0.18 | 0.22 | 0.59 | 0.021 | 0.025 | 0.024 | — | 0.0031 | 0.0035 | Bi: 0.11 | — | 670 × 10 | 32.5 | |
| D-1 | 0.11 | 0.26 | 0.50 | 0.016 | 0.003 | 0.019 | 0.0015 | 0.0039 | 0.0025 | — | 0.22 | 670 × 10 | 18.5 | Conventional electric resistance welded tube for machine structural use |
| D-2 | 0.23 | 0.25 | 0.62 | 0.017 | 0.002 | 0.025 | 0.0016 | 0.0040 | 0.0032 | — | 0.26 | 720 × 10 | 18.5 | |
| D-3 | 0.27 | 0.28 | 0.58 | 0.015 | 0.003 | 0.022 | 0.0011 | 0.0048 | 0.0028 | — | 0.14 | 850 × 10 | 18.5 | |
| D-4 | 0.31 | 0.26 | 0.56 | 0.018 | 0.002 | 0.015 | 0.0023 | 0.0041 | 0.0029 | Cr: 1.1, Mo: 0.19 | 0.36 | 850 × 10 | 18.5 | |

TABLE 2

| No. | UST yield (%) | Workability tests: Flattening | Flaring | Reverse flattening | Chip breakability | Remarks |
|---|---|---|---|---|---|---|
| A-1 | 90 | Good | Good | Good | 90 | |
| A-2 | 91 | Good | Good | Good | 85 | |
| A-3 | 95 | Good | Good | Good | 90 | |
| A-4 | 94 | Good | Good | Good | 80 | |
| A-5 | 98 | Good | Good | Good | 85 | |
| A-6 | 94 | Good | Good | Good | 95 | |
| A-7 | 95 | Good | Good | Good | 85 | |
| A-8 | 97 | Good | Good | Good | 90 | |
| A-9 | 90 | Good | Good | Good | 90 | |

1. An electric resistance welded steel tube for machine structural use exhibiting excellent machinability consisting of, in weight percent, 0.02–0.60% C,
not more than 0.4% Si,
0.20–2.0% Mn,
not more than 0.030% P,
not more than 0.040% S, 0.001–0.030% T.Al,
0.0020–0.0100% N,
not more than 0.0060% O, and
one or both of not more than 0.040% Bi and not more than 0.040% Pb, provided that the total amount of Bi and Pb is not more than 0.050%,
the remainder being Fe and unavoidable impurities.

2. An electric resistance welded steel tube for machine structural use exhibiting excellent machinability consisting of, in weight percent, 0.02–0.60% C,
not more than 0.4% Si,
0.20–2.0% Mn,
not more than 0.030% P,
not more than 0.040% S,
0.001–0.30% T.Al,
0.0020–0.0100% N,
not more than 0.0060% O,
one or both of not more than 0.040% Bi and not more than 0.040% Pb, provided that the total amount of Bi and Pb is not more than 0.050%, and
not more than 0.020% Ca, provided that $Ca\%/(1.25\times 0\%+0.625\times S\%) \geqq 0.05$,
the remainder being Fe and unavoidable impurities.

3. An electric resistance welded steel tube for machine structural use exhibiting excellent machinability consisting of, in weight percent, 0.02–0.060% C,
not more than 0.4% Si,
0.20–2.0% Mn,
not more than 0.030% S,
0.001–0.030% T.Al,
0.0020–0.0100% N,
not more than 0.0060% O,
one or both of 0.10–1.50% Cr and 0.10–0.60% Mo, and
one or both of not more than 0.040% Bi and not more than 0.040% Pb, provided that the total amount of Bi and Pb is not more than 0.050%,
the remainder being Fe and unavoidable impurities.

4. An electric resistance welded steel tube for machine structural use exhibiting excellent machinability consisting of, in weight percent, 0.02–0.60% C,
not more than 0.4% Si,
0.20–2.0% Mn,
not more than 0.030% P,
not more than 0.040% S,
0.001–0.030% T.Al,
0.0020–0.0100% N,
not more than 0.0060% O,
one or both of 0.10–1.50% Cr and 0.10–0.60% Mo,
one or both of not more than 0.40% Bi and not more than 0.040% Pb, provided that the total amount of Bi and Pb is not more than 0.050%, and
not more than 0.020% Ca, provided that $Ca\%/(1.25\times 0\%+0.625\times S\%) \geqq 0.05$,
the remainder being Fe and unavoidable impurities.

* * * * *